US010107125B2

(12) United States Patent
Rioux

(10) Patent No.: US 10,107,125 B2
(45) Date of Patent: Oct. 23, 2018

(54) SHROUD SEAL AND WEARLINER

(71) Applicant: United Technologies Corporation, Hartford, CT (US)

(72) Inventor: Philip Robert Rioux, North Berwick, ME (US)

(73) Assignee: United Technologies Corporation, Farmington, CT (US)

( * ) Notice: Subject to any disclaimer, the term of this patent is extended or adjusted under 35 U.S.C. 154(b) by 429 days.

(21) Appl. No.: 14/943,749

(22) Filed: Nov. 17, 2015

(65) Prior Publication Data

US 2016/0138412 A1 May 19, 2016

Related U.S. Application Data

(60) Provisional application No. 62/081,375, filed on Nov. 18, 2014.

(51) Int. Cl.

| | |
|---|---|
| ***F01D 11/00*** | (2006.01) |
| ***F04D 9/04*** | (2006.01) |
| ***F01D 9/04*** | (2006.01) |

(52) U.S. Cl.

CPC ..... *F01D 11/005* (2013.01); *F01D 9/041* (2013.01); *F01D 11/001* (2013.01); *F05D 2220/32* (2013.01); *F05D 2240/12* (2013.01); *F05D 2240/55* (2013.01); *F05D 2260/96* (2013.01)

(58) Field of Classification Search

CPC ..... F01D 9/041; F01D 11/005; F05D 2240/55
See application file for complete search history.

(56) References Cited

U.S. PATENT DOCUMENTS

| | | | | |
|---|---|---|---|---|
| 4,897,021 | A * | 1/1990 | Chaplin | F01D 5/22 267/160 |
| 5,785,499 | A | 7/1998 | Houston et al. | |
| 5,827,047 | A | 10/1998 | Gonsor et al. | |
| 5,868,398 | A | 2/1999 | Maier et al. | |
| 5,924,699 | A | 7/1999 | Airey et al. | |
| 6,077,035 | A | 6/2000 | Walters et al. | |
| 6,733,234 | B2 * | 5/2004 | Paprotna | F01D 11/005 277/637 |
| 6,910,854 | B2 | 6/2005 | Joslin | |
| 7,600,967 | B2 | 10/2009 | Pezzetti, Jr. et al. | |
| 8,398,366 | B2 * | 3/2013 | Twell | F01D 25/246 415/209.2 |
| 8,534,675 | B2 | 9/2013 | Heinz-Schwarzmaier et al. | |
| 8,708,641 | B2 | 4/2014 | Ueda et al. | |

(Continued)

*Primary Examiner* — Ninh H Nguyen
*Assistant Examiner* — Brian O Peters
(74) *Attorney, Agent, or Firm* — Kinney & Lange, P.A.

(57) ABSTRACT

A stator assembly includes a first stator vane sub-assembly with a first platform and a first airfoil extending from the first platform, and a second stator vane sub-assembly with a second platform and a second airfoil extending from the second platform. A gap is defined circumferentially between the first stator vane sub-assembly and the second stator vane sub-assembly. The stator assembly also includes a shroud structure, a first chamber defined between the first platform and the shroud structure, a second chamber defined between the second platform and the shroud structure, and a damper spring seal structure. Also included is a plate having a first portion within the first chamber and a second portion within the second chamber, such that the plate extends from the first chamber across the gap to the second chamber.

15 Claims, 4 Drawing Sheets

(56) References Cited

U.S. PATENT DOCUMENTS

| | | | |
|---|---|---|---|
| 2013/0323060 | A1 | 12/2013 | Boyington |
| 2014/0030100 | A1 | 1/2014 | Joshi et al. |
| 2014/0234111 | A1 | 8/2014 | Dungs et al. |

* cited by examiner

SHROUD SEAL AND WEARLINER

CROSS-REFERENCE TO RELATED APPLICATION(S)

This application claims the benefit of U.S. Provisional Application No. 62/081,375 filed Nov. 18, 2014, for "Shroud Seal and Wearliner" by Philip Robert Rioux.

BACKGROUND

The present embodiments relate generally to seals, and more particularly to seals for use within gas turbine engines.

Gas turbine engines include airfoils, such as blades and vanes, arranged in cascade configurations. These airfoils can be mounted circumferentially around a rotor or stator disk or case having one or more retention slots. The airfoils can include platforms that define a portion of a fluid flowpath boundary, such that adjacent airfoils mounted in the disk adjoin one another at their respective platform matefaces. However, an interface between adjacent platforms is not air tight, but instead defines a gap through which fluids can leak. Given that in many embodiments a single disk can have over 100 adjacent platforms, and thus over 100 gaps, the cumulative fluid leakage through the gaps can be significant, resulting in undesirable pressure loss and a reduction in efficiency.

Many current designs utilize a damper spring seal within a chamber defined between a platform and an inner and/or outer diameter shroud. However, use of the damper spring seal within the chamber creates multiple fluid leakage paths and results in heavy wear at the damper spring seal contact locations on the platform.

SUMMARY

One embodiment includes a stator assembly having a first stator vane sub-assembly with a first platform and a first airfoil extending from the first platform, and a second stator vane sub-assembly with a second platform and a second airfoil extending from the second platform. A gap is defined circumferentially between the first stator vane sub-assembly and the second stator vane sub-assembly. The stator assembly also includes a shroud structure, a first chamber defined between the first platform and the shroud structure, a second chamber defined between the second platform and the shroud structure, and a damper spring seal structure. Also included is a plate having a first portion within the first chamber and a second portion within the second chamber, such that the plate extends from the first chamber across the gap to the second chamber.

Another embodiment includes a method for reducing leakage in a stator stage. The method includes positioning a first portion of a plate within a first chamber defined between a first platform and a shroud, and positioning a second portion of the plate within a second chamber defined between a second platform and the shroud. The plate is positioned to extend from the first chamber across a gap defined between the first platform and the second platform to the second chamber.

Figure 1:
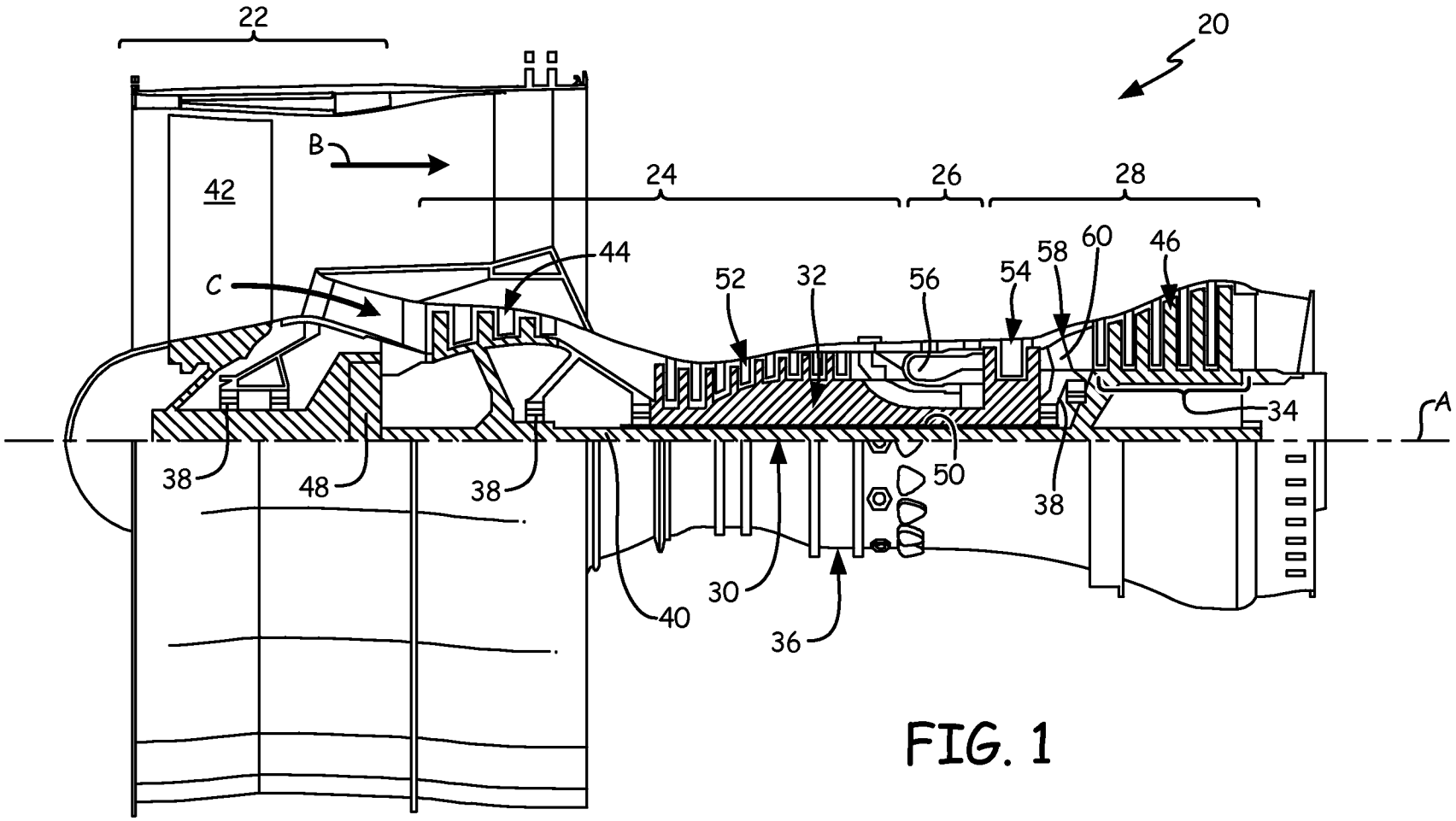
FIG. 1 is a schematic quarter sectional view of an embodiment of a gas turbine engine.

While the above-identified drawing figures set forth multiple embodiments of the invention, other embodiments are also contemplated. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings.

DETAILED DESCRIPTION

The present embodiments provide assemblies and methods for reducing fluid leakage between stator vanes as well as preventing platform wear. These benefits are achieved through the use of a plate extending across a circumferential gap between adjacent stator vane platforms and/or between adjacent stator vane segments.

FIG. 1 is a quarter sectional view that schematically illustrates an example gas turbine engine 20 that includes fan section 22, compressor section 24, combustor section 26 and turbine section 28. Alternative engines might include an augmenter section (not shown) among other systems or features. Fan section 22 drives air along bypass flow path B while compressor section 24 draws air in along core flow path C where air is compressed and communicated to combustor section 26. In combustor section 26, air is mixed with fuel and ignited to generate a high pressure exhaust gas stream that expands through turbine section 28 where energy is extracted and utilized to drive fan section 22 and compressor section 24.

Although the disclosed non-limiting embodiment depicts a turbofan gas turbine engine, it should be understood that the concepts described herein are not limited to use within turbofans as the teachings may be applied to other types of turbine engines; for example, an industrial gas turbine; a reverse-flow gas turbine engine; and a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

Example engine 20 generally includes low speed spool 30 and high speed spool 32 mounted for rotation about engine central longitudinal axis A relative to engine static structure 36 via several bearing systems 38. It should be understood that various bearing systems 38 at various locations may alternatively or additionally be provided.

Low speed spool 30 generally includes inner shaft 40 that connects fan 42 and low pressure (or first) compressor section 44 to low pressure (or first) turbine section 46. Inner shaft 40 drives fan 42 through a speed change device, such as geared architecture 48, to drive fan 42 at a lower speed than low speed spool 30. High-speed spool 32 includes outer shaft 50 that interconnects high pressure (or second) compressor section 52 and high pressure (or second) turbine section 54. Inner shaft 40 and outer shaft 50 are concentric and rotate via bearing systems 38 about engine central longitudinal axis A.

Combustor 56 is arranged between high pressure compressor 52 and high pressure turbine 54. In one example, high pressure turbine 54 includes at least two stages to provide double stage high pressure turbine 54. In another example, high pressure turbine 54 includes only a single stage. As used herein, a "high pressure" compressor or turbine experiences a higher pressure than a corresponding "low pressure" compressor or turbine.

Example low pressure turbine 46 includes turbine rotors schematically indicated at 34 and has a pressure ratio that is greater than about 5. The pressure ratio of example low pressure turbine 46 is measured prior to an inlet of low pressure turbine 46 as related to the pressure measured at the outlet of low pressure turbine 46 prior to an exhaust nozzle.

Mid-turbine frame 58 of engine static structure 36 can be arranged generally between high pressure turbine 54 and low pressure turbine 46. Mid-turbine frame 58 can include vanes 60 and further supports bearing systems 38 in turbine section 28 as well as setting airflow entering low pressure turbine 46.

Core airflow C is compressed by low pressure compressor 44 then by high pressure compressor 52 and mixed with fuel and ignited in combustor 56 to produce high speed exhaust gases that are then expanded through high pressure turbine 54 and low pressure turbine 46.

The disclosed gas turbine engine 20 in one example is a high-bypass geared aircraft engine. In a further example, gas turbine engine 20 includes a bypass ratio greater than about six (6), with an example embodiment being greater than about ten (10). Example geared architecture 48 is an epicyclical gear train, such as a planetary gear system, star gear system or other known gear system, with a gear reduction ratio of greater than about 2.3.

In one disclosed embodiment, gas turbine engine 20 includes a bypass ratio greater than about ten (10:1) and the fan diameter is significantly larger than an outer diameter of low pressure compressor 44. It should be understood, however, that the above parameters are only exemplary of one embodiment of a gas turbine engine including a geared architecture and that the present disclosure is applicable to other gas turbine engines with or without geared architecture.

A significant amount of thrust is provided by bypass flow B due to the high bypass ratio. Fan section 22 of engine 20 is designed for a particular flight condition—typically cruise at about 0.8 Mach and about 35,000 feet (10,668 m). The flight condition of 0.8 Mach and 35,000 ft. (10,668 m), with the engine at its best fuel consumption—also known as "bucket cruise Thrust Specific Fuel Consumption ('TSFC')"—is the industry standard parameter of pound-mass (lbm) of fuel per hour being burned divided by pound-force (lbf) of thrust the engine produces at that minimum point.

Figure 2:
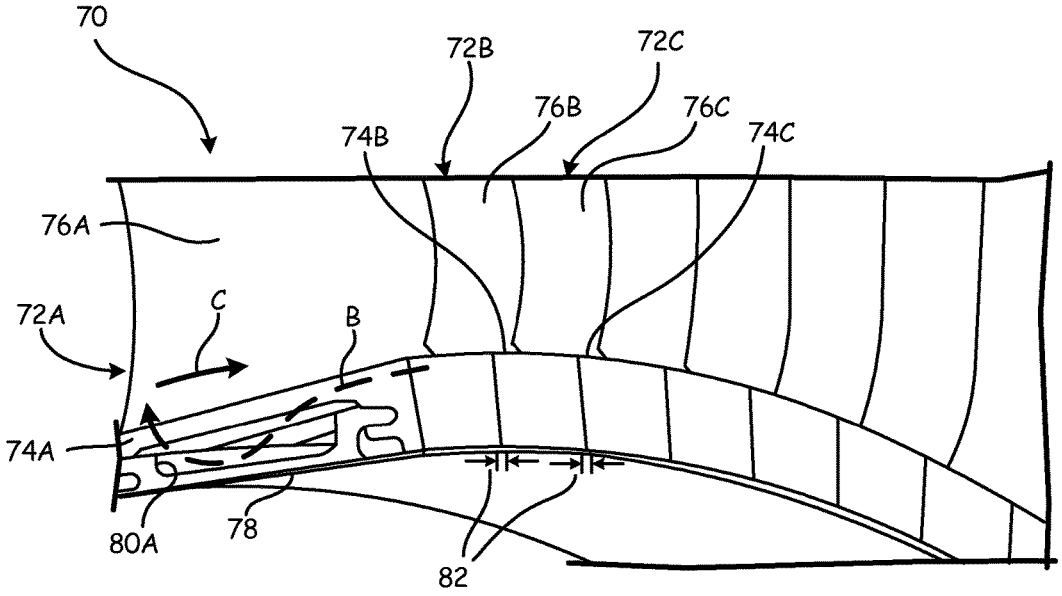
FIG. 2 is a perspective view of a portion of a stator stage.

FIG. 2 is a perspective view of a portion of stator stage 70. Stator stage 70 can be included, for example, as part of high pressure compressor section 52 or as part of any other section within engine 20 which utilizes a stator stage.

Stator stage 70 defines a stator assembly which includes a plurality of stator vane sub-assemblies 72A, 72B, and 72C (among other stator vane sub-assemblies). Stator vane sub-assemblies 72A, 72B, and 72C have platforms 74A, 74B, and 74C respectively. Airfoils 76A, 76B, and 76C extend from platforms 74A, 74B, and 74C respectively. Shroud structure 78 is mated to, and thus supported by, platform 74A on a side of platform 74A opposite airfoil 76A. In some embodiments, a honeycomb seal (not shown) can be carried on shroud structure 78. Shroud structure 78 as shown in FIG. 2 is an inner diameter shroud structure, but in other embodiments shroud structure 78 can be an outer diameter shroud structure. Shroud structure 78 can extend circumferentially from stator vane sub-assembly 72A across any number of stator vane sub-assemblies, such as adjacent sub-assemblies 72B and 72C, depending on the application. Thus, each individual stator vane sub-assembly includes at least a portion of a shroud structure. Defined between shroud structure 78 and platform 74A is chamber 80A. Each individual stator vane sub-assembly has a chamber defined between the sub-assembly's respective platform and shroud structure.

Although only a portion of stage 70 is shown in FIG. 2, those in the art will appreciate that stage 70 is made up of a plurality of individual stator vane sub-assemblies disposed circumferentially around, and mounted, for example, in retention slots of, a case (not shown). The number of individual stator vane sub-assemblies that make up stage 70 varies depending on the application, but in one embodiment stage 70 can include 180 individual stator vane sub-assemblies. As such, each individual stator vane sub-assembly, such as sub-assembly 72B, has adjacent stator vane sub-assemblies disposed on each side, such as sub-assemblies 72A and 72C.

The arrangement of individual stator vane sub-assemblies in stage 70 results in the platform of each individual sub-assembly interfacing with the platforms of the two adjacent stator vane sub-assemblies. For example, platform 74B of sub-assembly 72B interfaces with platform 74A of sub-assembly 72A on one side and platform 74C of sub-assembly 72C on an opposite side. The interface circumferentially between platforms 74A and 74B, as well as between platforms 74B and 74C, defines gap 82. Gaps 82 are present at all circumferential locations around stage 70 where adjacent platforms interface. For example, in one embodiment gaps 82 can range between 0.001 inch (0.0254 mm) and 0.0015 inch (0.0381 mm).

As core airflow C (i.e. gaspath flow) is passed through stage 70, airflow C passes between adjacent airfoils (e.g., 76A and 76B) and is bounded on one end by a flowpath defined by adjacent platforms (e.g. 74A and 74B). In addition to airflow C, stage 70 also receives backflow B. Backflow B is core airflow C which has already passed through stage 70 but is pushed back upstream to stage 70 by pressure generated by a rotor stage immediately downstream of stage 70. Backflow B can enter into gaps 82 as leakage and recirculate through an entire axial length of stage 70 with airflow C. In addition, airflow C can also enter or leak into gaps 82 as airflow C passes through stage 70. Consequently, the presence of gaps 82 results in leakage within stage 70, which when compounded over the many gaps 82 (e.g. 180 in one application) of stage 70 creates significant inefficiencies within stage 70.

Figure 3:
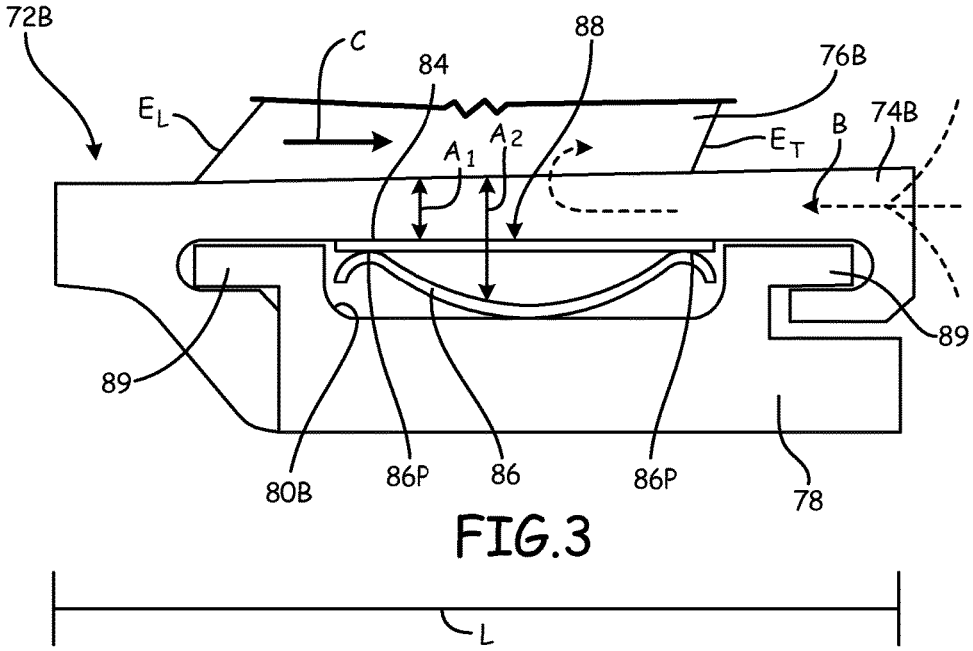
FIG. 3 is a side-elevational view of a stator vane assembly of the stator stage shown in FIG. 2, with a plate for reducing leakage and preventing wear.
Figure 4A:
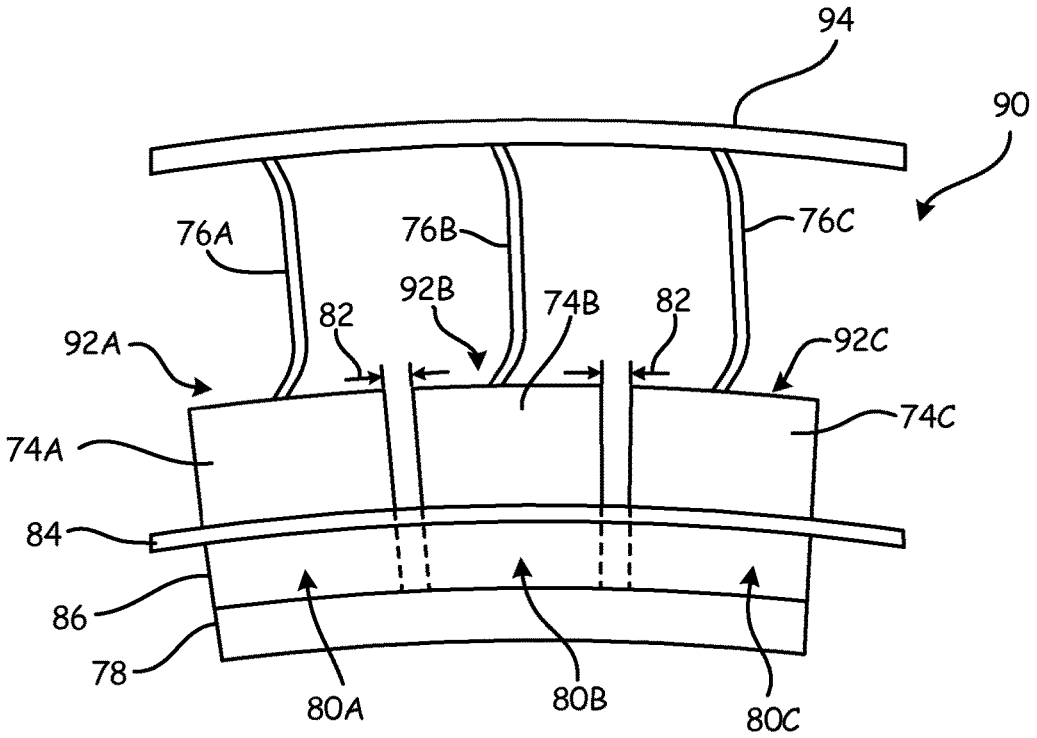
FIG. 4A is a schematic, cross-sectional view of an embodiment of a stator segment, made up of a multiple stator vane assemblies of FIG. 3.
Figure 4B:
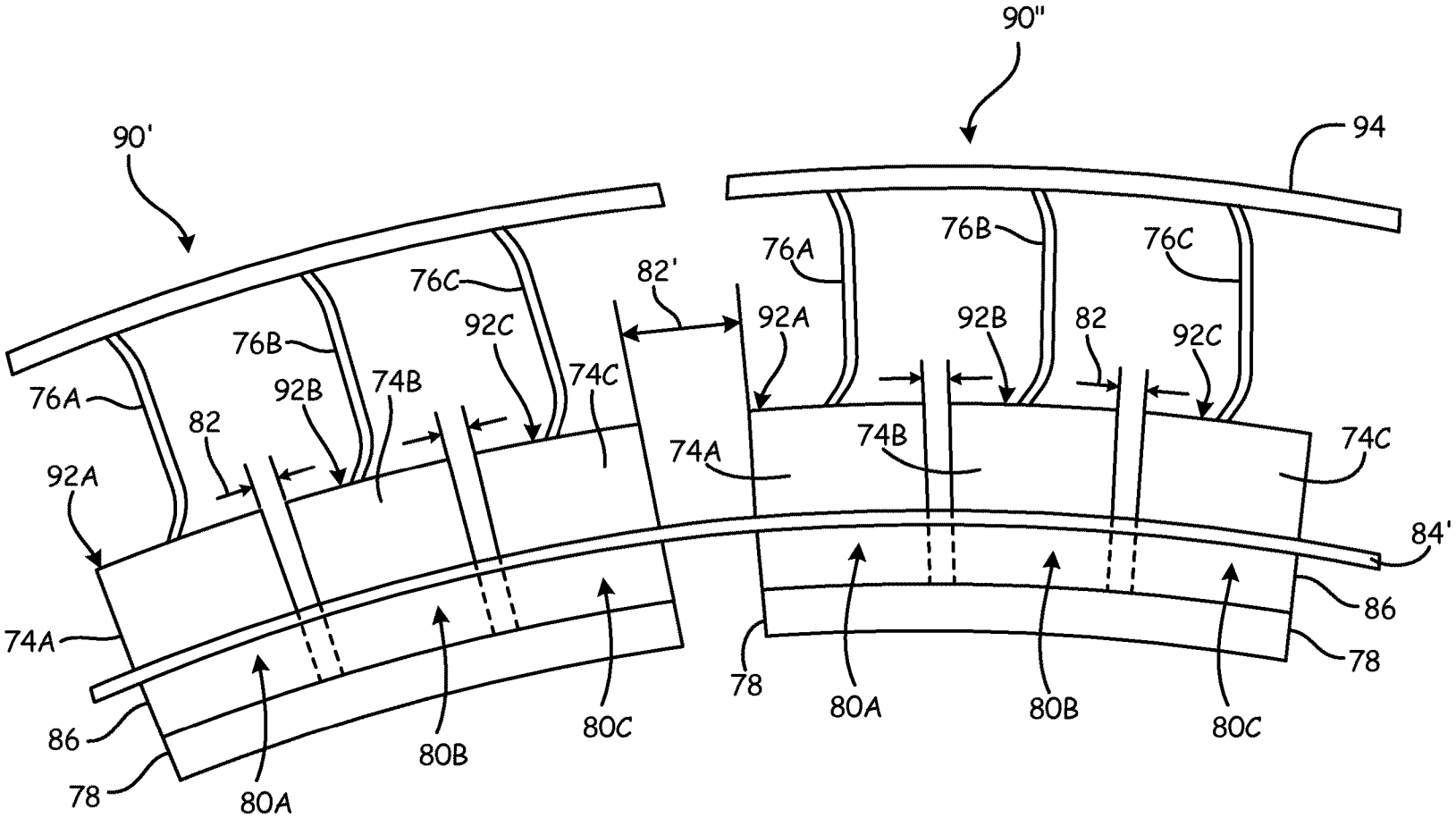
FIG. 4B is a schematic, cross-sectional view of an embodiment with a plate extending across multiple stator segments.

To reduce leakage within stage 70, plate 84 is included in stage 70 to extend across at least one gap 82 (discussed further with respect to FIGS. 4A and 4B). FIG. 3 is a side-elevational view of stator vane sub-assembly 72B of stage 70 (shown in FIG. 2). In addition to that described previously, sub-assembly 72B has chamber 80B defined between platform 74B and shroud structure 78. Located at least partially within chamber 80B is plate 84 and damper spring seal structure 86. Depending on the temperature and wear that plate 84 is expected to experience (which can vary depending upon the particular location within engine 20 where plate 84 is positioned), plate 84 can be made of appropriate material such as cobalt, nickel, Waspaloy®, and/or alloys thereof. As illustrated, plate 84 has a rectangular cross-sectional shape, but in other embodiments plate 84 can have various other suitable cross-sectional shapes. Plate 84 is solid at all portions of plate 84 (i.e. plate 84 has no apertures along its length). At least a portion of plate 84 can be secured within chamber 80B between damper spring seal structure 86 and platform 74B. In one embodiment, plate 84 is secured in chamber 80B via an interference fit between structure 86 and platform 74B, but in other embodiments plate 84 can be secured in chamber 80B between structure 86 and platform 74B through use of any other fixing means taking into consideration potential differential thermal expansion. Damper spring seal structure 86 can be a conventional damper spring seal as is known in the art.

Use of plate 84 across gap 82 redirects backflow B passing through gap 82. Plate 84 reduces an area that backflow B has available to flow through when passing through gap 82, from area $A_2$ available for backflow B when plate 84 is not used (e.g., FIG. 2) to reduced area $A_1$ when plate 84 is used. In other words, use of plate 84 results in backflow B being pushed through a smaller area ($A_1$). Backflow B, in addition to being bounded on an inner end by plate 84, is bounded on an outer end by airflow C, which tends to provide laminar or near laminar flow along at least upstream portions of platforms 74A, 74B, 74C and acts as a type of air curtain on backflow B. The reduced area $A_1$ resulting from use of plate 84, as well as the air curtain defined by airflow C, creates a small area choke point 88. Choke point 88 is a location where a pressure point across gap 82 changes from being in a direction from airfoil trailing edge $E_T$ to airfoil leading edge $E_L$ to a direction from airfoil leading edge $E_L$ to airfoil trailing edge $E_T$. In the illustrated embodiment, choke point 88 is located approximately halfway along an axial length L of platform 74B. Therefore, plate 84 results in backflow B being pushed through smaller area $A_1$ when passing through gap 82 and redirected to flow in the same direction as airflow C (i.e. from airfoil leading edge $E_L$ to airfoil trailing edge $E_T$). This then reduces recirculation of backflow B and ultimately leakage across stage 70. Furthermore, use of plate 84 also reduced or substantially eliminates any airflow C leakage into gap 82. In one application, use of plate 84 in stage 70 can reduce leakage across stage 70 by approximately 7-12%.

In addition to reducing leakage across stage 70, plate 84 serves to reduce wear on platform 74B. In conventional stator vane sub-assemblies (i.e. no plate 84 is used), at least a portion 86P of damper spring seal structure 86 directly comes into contact with platform 74B. In the illustrated embodiment, structure 86 has a substantially "U" shaped cross-section such that structure 86 comes into contact with platform 74B at two portions 86P which are located near ends of structure 86 along length L. However, in other embodiments various other shapes of structure 86 can be used and in such embodiments plate 84 can still be positioned between what would otherwise be at least one contact point between structure 86 and platform 74B. This contact between portion 86P and platform 74B can yield significant wear on platform 74B. Use of plate 84 between platform 74B and damper spring seal structure 86 results in wear on plate 84, for example where plate 84 contacts with portion 86P, instead of wear on platform 74B. A portion of plate 84 can be positioned within chamber 80B such that plate 84 and damper spring seal structure 86 are configured inward along length L of attachment lugs 89, which are disposed on opposite sides of shroud structure 78 along length L. Due to the positioning of plate 84 and the resulting wear plate 84 absorbs, a significant cost savings can result by increasing the useful life of relatively expensive platform 74B and instead replacing relatively inexpensive plate 84 over time. Additional cost savings can also be achieved using plate 84, because platform 74B need not have a wear coating applied.

FIG. 4A shows a schematic, cross-sectional view of an embodiment of stator segment 90. In some applications a stator stage, such as stage 70 partially shown in FIG. 2, can be made up of multiple stator segments 90 circumferentially disposed around a case. Each stator segment 90 can include any number of individual stator vane sub-assemblies depending on the application.

Stator segment 90 as shown in FIG. 4A is made up of three individual stator vane sub-assemblies 92A, 92B, and 92C. Stator vane sub-assemblies 92A, 92B, and 92C have platforms 74A, 74B, and 74C respectively. Airfoils 76A, 76B, and 76C extend from platforms 74A, 74B, and 74C respectively. Segment 90 can also include an outer diameter endwall 94. Shroud structure 78 as shown in FIG. 4A extends across the entire stator segment 90, such that shroud structure 78 begins on one end of segment 90 at subassembly 92A and extends to the other end of segment 90 at subassembly 92C. Shroud structure 78 can be supported at the ends of sub-assemblies 92A and 92C only or in other embodiments can be supported at various locations along segment 90.

Defined between each platform 74A, 74B, and 74C and shroud structure 78 are chambers 80A, 80B, and 80C respectively. Damper spring seal structure 86 as shown in FIG. 4A extends across the entire stator segment 90 similar to shroud structure 78, except that damper spring seal structure 86 extends across the segment 90 from chamber to chamber. Thus, damper spring seal structure 86 begins within chamber 80A, extends into chamber 80B, and ends within chamber 80C. Plate 84 also extends across the entire segment 90, including across gaps 82 defined at an interface between platforms 74A and 74B and platforms 74B and 74C. Plate 84 begins within chamber 80A and can be secured within chamber 80A between platform 74A and damper spring seal structure 86, extends across gap 82 and into chamber 80B where plate 84 can be secured within chamber 80B between platform 74B and structure 86, and finally extends across gap 82 and into chamber 80C where plate 84 can be secured within chamber 80C between platform 74C and structure 86. In further embodiments, plate 84 can additionally extend out from end chambers 80A and 80C a distance sufficient to prevent leakage between gaps 82 defined between adjacent segments 90.

FIG. 4B shows a schematic, cross-sectional view of an embodiment of multiple, circumferentially adjacent segments 90' and 90". Each stator segment 90' and 90" is configured similar to that described for segment 90 with respect to FIG. 4A, with the exception of the configuration of plate 84'. Shroud structures 78 and damper spring seal structures 86 again each extend across all of segment 90' and 90" respectively, each terminating at ends of segments 90' and 90" respectively.

In addition to the gaps 82 defined between the platforms within each segment 90' and 90", an additional gap 82' is shown in FIG. 4B between adjacent segments 90' and 90". This additional gap 82' begins at an end of platform 74C of segment 90' and terminates at a beginning of platform 74A of segment 90". The difference in FIG. 4B is that plate 84' extends across gap 82'. Thus plate 84' not only extends across gaps 82 of each segment 90' and 90", but also extends from chamber 80C of segment 90' into chamber 80A of segment 90". As a result, use of plate 84' to additionally extend across the gap 82' between segments 90' and 90" further reduces leakage as compared to the configuration of plate 84 in FIG. 4A where gap 82' may not be fully accounted for and result additional leakage points. In further embodiments, plate 84' can be configured to extend across three or more segments such that plate 84' extends across two or more gaps 82'.

Discussion of Possible Embodiments

The following are non-exclusive descriptions of possible embodiments of the present invention.

A stator assembly comprising: a first stator vane sub-assembly comprising, a first platform; and a first airfoil extending from the first platform; a second stator vane sub-assembly comprising, a second platform; and a second airfoil extending from the second platform; a gap defined circumferentially between the first stator vane sub-assembly and the second stator vane sub-assembly; a shroud structure selected from the group consisting of (a) a first shroud supported by the first platform on a side of the first platform opposite the airfoil and extending across the gap to the second stator vane sub-assembly, and (b) a second shroud and a third shroud, wherein the second shroud is supported by the second platform on a side of the second platform opposite the airfoil and extends in a direction opposite the first stator vane sub-assembly and the third shroud is supported by the first platform on a side of the first platform opposite the airfoil and extends in a direction opposite the second stator vane sub assembly; a first chamber defined between the first platform and the shroud structure; a second chamber defined between the second platform and the shroud structure; a damper spring seal structure selected from the group consisting of (a) a first damper spring seal located within the first chamber and extending into the second chamber, and (b) a second damper spring seal and a third damper spring seal, wherein the second damper spring seal is located within the second chamber and extends in a direction opposite the first chamber and the third damper spring seal is located within the first chamber and extends in a direction opposite the second chamber; and a plate with a first portion within the first chamber and a second portion within the second chamber, wherein the plate extends from the first chamber across the gap to the second chamber.

The assembly of the preceding paragraph can optionally include, additionally and/or alternatively, the following features, configurations and/or additional components:

The first portion of the plate is secured within the first chamber between the damper spring seal structure and the first platform and the second portion of the plate is secured within the second chamber between the damper spring seal structure and the second platform.

The first stator vane sub-assembly and the second stator vane sub-assembly are both included as part of a single stator segment.

The first stator vane sub-assembly and the second stator vane sub-assembly are each included as part of different stator segments.

The shroud structure is an inner diameter shroud structure.

A third portion of the plate within a third chamber of a third stator vane sub-assembly, wherein the plate extends from the second chamber across a second gap defined circumferentially between the second stator vane sub-assembly and the third stator vane sub-assembly to the third chamber.

At least one of the first, second, or third shrouds of the shroud structure includes attachment lugs on opposite side of the at least one of the first, second, or third shrouds, and wherein the plate and the damper spring seal structure are configured inward of the lugs.

The plate has a rectangular cross-sectional shape.

A method for reducing leakage in a stator stage, the method comprising: positioning a first portion of a plate within a first chamber defined between a first platform and a shroud; and positioning a second portion of the plate within a second chamber defined between a second platform and the shroud, such that the plate is positioned to extend from the first chamber across a gap defined between the first platform and the second platform to the second chamber.

The method of the preceding paragraph can optionally include, additionally and/or alternatively, the following techniques, steps, features and/or configurations:

Installing a damper spring seal within the first chamber and configuring the damper spring seal to extend from the first chamber to the second chamber.

Positioning the first portion of the plate in the first chamber comprises positioning the first portion of the plate between the damper spring seal and the first platform, and wherein positioning the second portion of the plate in the second chamber comprises positioning the second portion of the plate between the damper spring seal and the second platform.

Positioning a third portion of the plate within a third chamber defined between a third platform and the shroud, such that the plate is positioned to extend from the second chamber across a second gap defined between the second platform and the third platform to the third chamber.

Passing a gaspath flow from a leading edge of the first platform to a trailing edge of the first platform; and passing a backflow in a direction from a trailing edge of the first platform towards a leading edge of the first platform, wherein the backflow is redirected in a same direction as the gaspath flow before reaching the leading edge of the first platform.

The backflow is redirected to a choke point substantially centered axially along the gap defined between the first platform and the second platform.

Removing a wear coating from a side of the first platform that interfaces with the first portion of the plate.

A stator vane segment comprising: a plurality of adjacent stator vane assemblies, each stator vane assembly comprising: a platform; and an airfoil extending outward from the platform; a shroud supported by the platform of a first stator vane assembly on an end of the segment, wherein the shroud is supported on a side of the platform opposite the airfoil, and wherein the shroud extends across each stator vane assembly of the segment; a chamber defined between the platform of each stator vane assembly and the shroud; a damper spring seal located within the chamber of the first stator vane assembly on the end of the segment and extending across the segment such that the damper spring seal is located within the chamber of each stator vane assembly of the segment; a gap defined circumferentially between each stator vane assembly of the segment; and a plate extending from within the chamber of the first stator vane assembly on the end of the segment across the gap between each stator vane assembly of the segment to the chamber of a stator vane assembly on an end of the segment opposite the first stator vane assembly.

The segment of the preceding paragraph can optionally include, additionally and/or alternatively, the following features, configurations and/or additional components:

A portion of the plate within the chamber of the first stator vane assembly is configured between the platform and the damper spring seal.

The gap defined circumferentially between each stator vane assembly of the segment ranges between 0.001 inch (0.0254 mm) and 0.0015 inch (0.0381 mm).

The plate has a rectangular cross-sectional shape.

A gaspath flow passing from a leading edge of a stator vane assembly to a trailing edge of the stator vane assembly; and a backflow passing in a direction from a trailing edge of the stator vane assembly toward a leading edge of the stator vane assembly.

Any relative terms or terms of degree used herein, such as "generally", "substantially", "approximately", and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, temporary alignment or shape variations induced by operational conditions, and the like.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A stator assembly comprising:

a first and a second stator vane segment positioned adjacent to one another and separated by a segment gap, each of the first and second stator vane segments comprising:

a first stator vane sub-assembly comprising, a first platform; and a first airfoil extending from the first platform;

a second stator vane sub-assembly comprising, a second platform; and a second airfoil extending from the second platform;

a gap defined circumferentially between the first stator vane sub-assembly and the second stator vane sub-assembly;

a shroud structure comprising a first shroud supported by the first platform on a side of the first platform opposite the airfoil and extending across the gap to the second stator vane sub-assembly;

a first chamber defined between the first platform and the shroud structure;

a second chamber defined between the second platform and the shroud structure; and a damper spring seal structure selected from the group consisting of (a) a first damper spring seal located within the first chamber and extending into the second chamber, wherein the first damper spring seal is confined to the first and second chambers, and (b) a second damper spring seal and a third damper spring seal, wherein the second damper spring seal is located within the second chamber and extends in a direction opposite the first chamber and the third damper spring seal is located within the first chamber and extends in a direction opposite the second chamber, wherein the second and third damper spring seals are confined to the first and second chambers; and a plate with a first portion within the first chamber and a second portion within the second chamber, wherein the plate extends from the first chamber across the gap to the second chamber; and wherein the plate extends across the segment gap between the first and second stator vane segments.

2. The stator assembly of claim 1, wherein the first portion of the plate is secured within the first chamber between the damper spring seal structure and the first platform and the second portion of the plate is secured within the second chamber between the damper spring seal structure and the second platform.

3. The stator assembly of claim 1, wherein the shroud structure is an inner diameter shroud structure.

4. The stator assembly of claim 1, further comprising a third portion of the plate within a third chamber of a third stator vane sub-assembly, wherein the plate extends from the second chamber across a second gap defined circumferentially between the second stator vane sub-assembly and the third stator vane sub-assembly to the third chamber.

5. The stator assembly of claim 1, wherein at least one of the first, second, or third shrouds of the shroud structure includes attachment lugs on opposite side of the at least one of the first, second, or third shrouds, and wherein the plate and the damper spring seal structure are configured inward of the lugs.

6. The stator assembly of claim 1, wherein the plate has a rectangular cross-sectional shape.

7. A method for reducing leakage in a stator stage, the method comprising:

positioning a first portion of a plate within a first chamber defined between a first platform and a first shroud;

positioning a second portion of the plate within a second chamber defined between a second platform and the first shroud, such that the plate is positioned to extend from the first chamber across a gap defined between the first platform and the second platform to the second chamber, wherein the first platform, second platform, and first shroud form a portion of a first stator vane segment; and positioning a third portion of the plate within a third chamber defined between a third platform and a second shroud, wherein the third platform and second shroud form a portion of a second stator vane segment, and wherein the plate is positioned to extend from the second chamber across a segment gap defined between the first and second stator vane segments to the third chamber;

installing a first damper spring seal within the first chamber and configuring the damper spring seal to extend from the first chamber to the second chamber, wherein the damper spring seal is confined to the first and second chambers; and installing a second damper spring seal within the third chamber.

8. The method of claim 7, wherein positioning the first portion of the plate in the first chamber comprises positioning the first portion of the plate between the damper spring seal and the first platform, and wherein positioning the second portion of the plate in the second chamber comprises positioning the second portion of the plate between the damper spring seal and the second platform.

9. The method of claim 7, further comprising:

passing a gaspath flow from a leading edge of the first platform to a trailing edge of the first platform; and passing a backflow in a direction from a trailing edge of the first platform towards a leading edge of the first platform, wherein the backflow is redirected in a same direction as the gaspath flow before reaching the leading edge of the first platform.

10. The method of claim 9, wherein the backflow is redirected to a choke point substantially centered axially along the gap defined between the first platform and the second platform.

11. A stator vane assembly comprising:

a first and a second stator vane segment positioned adjacent one another and separated by a first segment gap, each of the first and second stator vane segments comprising:

a plurality of adjacent stator vane sub-assemblies, each stator vane sub-assembly comprising:

a platform; and an airfoil extending outward from the platform;

a shroud supported by the platform of a first stator vane sub-assembly on an end of the segment, wherein the shroud is supported on a side of the platform opposite the airfoil, and wherein the shroud extends across each stator vane sub-assembly of the segment;

a chamber defined between the platform of each stator vane sub-assembly and the shroud;

a damper spring seal located within the chamber of the first stator vane sub-assembly on the end of the segment and extending across the segment such that the damper spring seal is located within the chamber of each stator vane sub-assembly of the segment, wherein the damper spring seal is confined to the chambers of the segment;

a gap defined circumferentially between each stator vane sub-assembly of the segment; and a plate extending from within the chamber of the first stator vane sub-assembly on the end of the segment across the gap between each stator vane sub-assembly of the segment and extending across the first segment gap between the first and second stator vane segments.

12. The stator vane assembly of claim 11, wherein a portion of the plate within the chamber of the first stator vane assembly is configured between the platform and the damper spring seal.

13. The stator vane assembly of claim 11, wherein the gap defined circumferentially between each stator vane assembly of the segment ranges between 0.001 inch (0.0254 mm) and 0.0015 inch (0.0381 mm).

14. The stator vane assembly of claim 11, wherein the plate has a rectangular cross-sectional shape.

15. The stator vane assembly of claim 11, further comprising:

a gaspath flow passing from a leading edge of a stator vane assembly to a trailing edge of the stator vane assembly; and a backflow passing in a direction from a trailing edge of the stator vane assembly toward a leading edge of the stator vane assembly.

* * * * *